US008336560B2

(12) United States Patent
Dumler et al.

(10) Patent No.: US 8,336,560 B2
(45) Date of Patent: Dec. 25, 2012

(54) COSMETIC BRUSH WITH BRISTLES INJECTION-MOLDED TO A MAIN BODY

(75) Inventors: Norbert Dumler, Ansbach (DE); Friedrich Weigel, Wittelshofen (DE)

(73) Assignee: GEKA GmbH, Bechhofen (DE)

( * ) Notice: Subject to any disclaimer, the term of this patent is extended or adjusted under 35 U.S.C. 154(b) by 585 days.

(21) Appl. No.: 12/362,282

(22) Filed: Jan. 29, 2009

(65) Prior Publication Data

US 2009/0193602 A1 Aug. 6, 2009

(30) Foreign Application Priority Data

Feb. 1, 2008 (EP) ..... 08001932

(51) Int. Cl.
*A45D 40/26* (2006.01)

(52) U.S. Cl. ..... 132/218

(58) Field of Classification Search ..... 132/218, 132/320

See application file for complete search history.

(56) References Cited

U.S. PATENT DOCUMENTS

| | | | | |
|---|---|---|---|---|
| 6,412,496 | B1 | 7/2002 | Gueret | |
| 2005/0172439 | A1 | 8/2005 | Weihrauch | |
| 2009/0065020 | A1* | 3/2009 | Butcher et al. | 132/218 |
| 2009/0114239 | A1* | 5/2009 | Chen | 132/218 |

FOREIGN PATENT DOCUMENTS

| | | | |
|---|---|---|---|
| DE | 25 59 273 | A1 | 7/1977 |
| EP | 0 038 524 | A2 | 10/1981 |
| EP | 1 070 466 | A1 | 1/2001 |
| EP | 1 475 013 | A1 | 11/2004 |
| EP | 1 507 640 | B1 | 2/2005 |
| EP | 1 602 300 | A1 | 12/2005 |
| EP | 1 665 952 | A2 | 6/2006 |
| WO | 03/097324 | A2 | 11/2003 |
| WO | 2006/130643 | A2 | 12/2006 |
| WO | 2007/146212 | A1 | 12/2007 |

OTHER PUBLICATIONS

European Patent Office Search Report dated Jun. 27, 2008 issued in Appln No. EP 08 001 932.6.

* cited by examiner

*Primary Examiner* — Rachel Steitz
(74) *Attorney, Agent, or Firm* — Browdy and Neimark, P.L.L.C.

(57) ABSTRACT

A cosmetic brush having a bristle section having a main body and bristles that project out from the main body and with which a cosmetic product can be applied. A portion of the bristles forms first bristles that are integrally connected to the main body, wherein the first bristles consist of the same first plastic material as the main body. Another portion of the bristles forms second bristles, softer than the first bristles that are connected to the main body differently than the first bristles. The second bristles are integrally connected to each other by means of a connecting member disposed on the side of the main body wall facing away from the second bristles, and extend through through holes provided in a main body wall, wherein the main body and the connecting member are immediately adjacent to each other and adhesively connected to each other.

20 Claims, 7 Drawing Sheets

COSMETIC BRUSH WITH BRISTLES INJECTION-MOLDED TO A MAIN BODY

Figure 1:
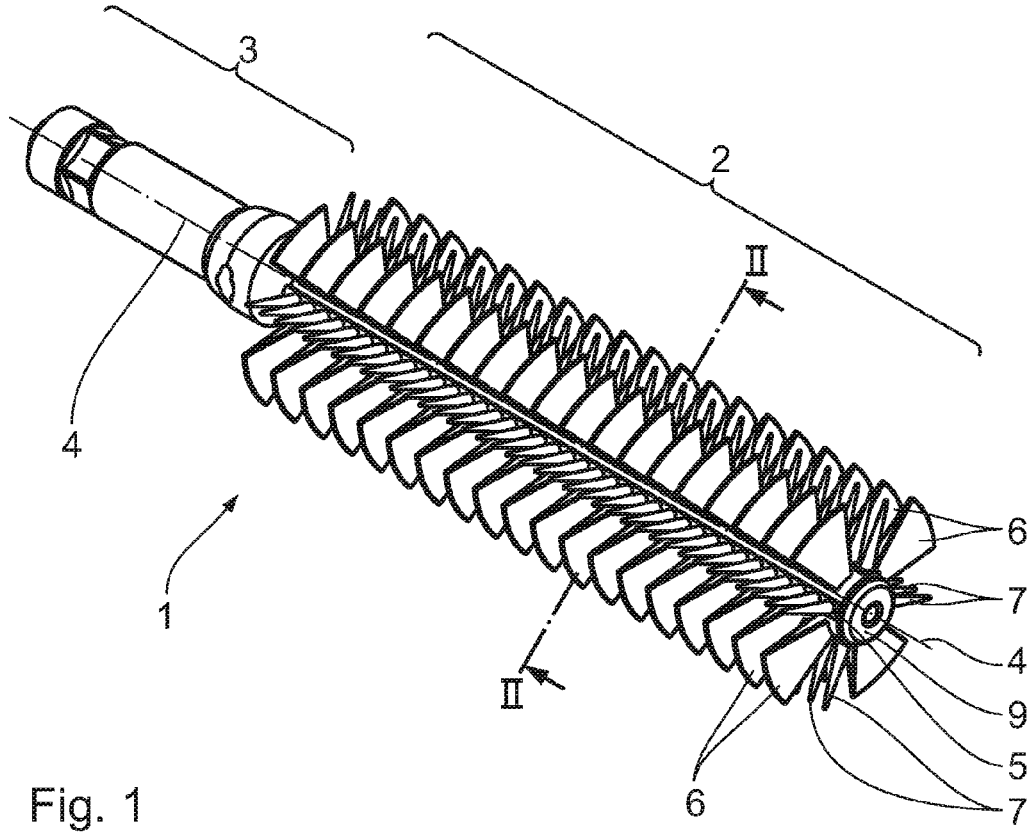

The invention relates to a cosmetic brush, in particular to a mascara brush or a hair coloring brush, comprising a bristle section having a main body and a multiplicity of bristles that project out from the main body and with which a cosmetic product can be applied.

A cosmetic brush of this type is described, for example, in DE 25 59 273. In this exemplary embodiment of a cosmetic brush the main body and all bristles are integrally connected to each other. They consist of an elastically yielding plastic material, such as e.g. a polyethylene. The main body and the bristles that are injection-molded to it are produced by means of a one-component injection molding process.

In EP 1 507 640 B1, an improved production method is described that can be used also for cosmetic brushes. It is a two-stage process, in which two different plastic materials are used. This injection molding process is also referred to as 2K method. In one variant, the main body is produced first, as a substantially hollow cylindrical structure, in order to then inject in a second step an additional plastic material in a molten state under high pressure into the hollow space of the main body that was produced first. Because of the high injection pressure, the molten second plastic material shoots through the wall of the hollow main body and extends into radially projecting bristle recesses. In this manner it is possible to produce very advantageous cosmetic brushes, in which the main body consists of a first plastic material and the bristles consist of a second plastic material. This method of production has proven effective in practice. The cosmetic brushes that are produced with it have very good performance characteristics.

Additional cosmetic brushes are known from WO 2006/130 643 A2, EP 1 070 466 A2, EP 1 475 013 A1, EP 1 602 300 A1, WO 2007/146 212 A1 and EP 0 038 524 A2.

Nonetheless, the desires and requirements of users of such cosmetic brushes continue to grow.

It is therefore the object of the present invention to specify a cosmetic brush of the type described at the beginning that has further improved performance characteristics.

To meet this object, a cosmetic brush according to the characteristics of claim 1 is specified. In the inventive cosmetic brush a portion of the bristles forms first bristles that are integrally connected to the main body, with these first bristles consisting of the same first plastic material as the main body. Another portion of the bristles in the inventive cosmetic brush forms second bristles that are connected to the main body in a different manner than the first bristles. The main body has a main body wall that is provided with through holes, and the second bristles are integrally connected to each other by means of a connecting member that is disposed on a side of the main body wall facing away from the second bristles and extend through the perforation holes, with the main body and the connecting member being disposed immediately adjacent to each other and connected to each other in an adhesive manner. The main body is designed in the form of a hollow cylinder and integrally connected to a handle extension piece. The second bristles are softer and more flexible than the first bristles. The cosmetic brush is designed as an injection-molded plastic piece.

In the inventive cosmetic brush, two different bristles types are thus provided. Whereas the first bristles are, in particular, integrally injection-molded to the main body, this does not hold true in this manner for the second bristles. Here, no provision is made for an integral connection to the main body. The first bristles and the second bristles are preferably produced in different process steps of a common injection molding process. They have different behaviors. Each bristle type can be optimized in a targeted manner toward one or a plurality of performance characteristics. It is thus possible, for example, that the first bristles, which are permanently and integrally connected to the main body, are designed for a particularly good and effective initial treatment of the eyelashes or hairs that are initially completely in disorder. Within the framework of this initial treatment, in particular a parting of eyelashes or hair into sections takes place. The softer second bristles, on the other hand, are designed, for example, for a particularly good and effective subsequent treatment of the eyelashes or hairs that were previously separated or sectioned off within the framework of the initial treatment. Within the framework of the subsequent treatment, in particular a further separation and singularization of the eyelashes or hairs takes place, as well as a combing of the eyelashes or hairs and a coating or application of the cosmetic product onto the eyelashes or hair. The inventive brush is thus characterized by improved performance characteristics over the prior art.

The second bristles are produced in particular by means of the production method that is described in the prior art in accordance with EP 1 507 640 B1. They are injected through the main body wall. This results also in a particularly good cohesion of the second bristles with each other. The inventive cosmetic brush is, therefore-even though it is composed of two component parts and preferably of two different plastic materials-a uniform injection-molded plastic piece, i.e. a component that is produced in particular within the framework of a single common process. This is apparent above all from the tight adhesive connection between the two component parts, i.e. for example, also between the main body and the connecting member.

Advantageous designs of the inventive cosmetic brush will become apparent from the characteristics of the dependent claims on claim 1.

According to a preferred embodiment, the second bristles are connected to the main body firmly bonded, or frictionally, or form-fittingly. This provides for a secure connection between the main body and the second bristles over the entire usable life of the cosmetic brush.

According to another preferred embodiment, the second bristles consist of a second plastic material that differs from the first plastic material. This second plastic material is, in particular, softer and more flexible than the first plastic material and/or it has a lower Shore hardness than the first plastic material. By selecting different materials, the properties of both bristle types can be adapted particularly effectively to the respective task, namely, e.g. an optimal sectioning effect for the first bristles on one hand, and an optimal separation, combing and application behavior for the second bristles, on the other hand. In order to be able to apply the cosmetic product as well as possible, it is advantageous if the second bristles are designed softer and more flexible than the first bristles. This can be achieved, on one hand, by an accordingly softer material, but also by means of a suitable shaping and dimensioning. The second bristles may thus e.g. preferably also be dimensioned narrower or thinner than the first bristles. The second bristles then have a softer and more flexible behavior than the first bristles also. The first bristles, therefore, are in particular hard bristles, the second bristles, on the other hand, are soft bristles. For the material of both bristle types a Shore hardness, in particular, of A 40 to A 90 or D 30 to D 80 is suitable, with the Shore hardness of the material of the first bristles preferably being greater than the Shore hardness of the material of the second bristles.

According to another preferred embodiment, the second bristles have an outwardly—i.e. particularly toward their free bristle ends—sharply tapered conical shape in each case, with a cone angle of 1° to 5°, particularly approximately 4°. This cone shape of the second bristles is advantageous on one hand for the application behavior. On the other hand, bristle geometries of this type are easier to produce with the above-described injection molding process. The cone shape of the bristles facilitates the removal from the injection mold. In an embodiment of the cosmetic brush as a mascara brush, the second bristles have a base diameter, in particular, in the range between 0.2 mm and 0.8 mm, with the base diameter being the diameter of the (second) bristles at the point of transition to the main body. In an embodiment of the cosmetic brush as a brush for hair coloring, the base diameter of the second bristles, on the other hand, is preferably in the range between 0.5 mm and 2 mm.

According to another preferred embodiment, the main body has a longitudinal axis and a circumferential direction relative to the longitudinal axis, and the first and the second bristles alternate in the circumferential direction at least in sections. In the direction of the longitudinal axis, on the other hand, preferably always only one of the two bristle types is provided at a circumferential angular position. This guarantees that, when the cosmetic product is applied, which is usually done with a rotational movement of the cosmetic brush, at least one section with the first bristle type and one section with the second bristle type participates, so that both specifically optimized properties take effect.

According to another preferred embodiment, circumferential sections are provided within which exclusively first or second bristles are disposed, with one of these circumferential sections extending in the circumferential direction over a circumferential angular span between 25° and 90°, in particular between 30° and 60°. With such an extent in the circumferential direction it is guaranteed that, during the application of the cosmetic product by means of a rotational movement of the cosmetic brush, as explained in the previous paragraph, both types of bristles participate in each case, preferably first the, in particular, harder first bristles and then the, in particular, softer second bristles.

According to another preferred embodiment, first and second bristles are disposed immediately adjacent to each other at least in parts. In particular, adjacent first and second bristles may be in contact with each other.

Additionally, there may also be an at least partial form closure between these immediately adjoining first and second bristles. This achieves that the region in which a good sectioning effect exists due to one of the two bristle types, transitions immediately into the adjoining region with the other bristle type in which a particularly good separation, combing and application behavior exists.

According to another preferred embodiment, the first bristles have the same basic geometric shape as the second bristles. Specifically optimized performance characteristics are then achieved for each of the two bristle types in each case, in particular due to a different material selection and/or due to a different dimensioning. In particular, the first bristles may also have an outwardly—i.e. particularly toward their free bristle ends—sharply tapered conical shape. For the case in which both bristle types have the same basic cone shape, the first bristles have, in particular, a base diameter that is 0.2 mm larger than that of the second bristles.

According to another preferred embodiment, the main body has a longitudinal axis and the first bristles have a lesser bristle thickness in the direction of the longitudinal axis than the second bristles. Due to the advantageous higher axial bristle thickness of the second bristles, the desired greater separation and singularization effect is attained, as compared to the first bristles, which, in particular, effect only a partial sectioning of the eye lashes or hairs. The greater axial bristle thickness of the second bristles additionally also has the effect that the cosmetic product to be applied can be applied very well and ideally onto just a single eyelash or a single hair.

According to another preferred embodiment, the first bristles have a different geometric shape than the second bristles. The geometric shape also is a parameter, as already mentioned above, whereby specific properties can be adjusted in a targeted manner.

According to another preferred embodiment, the first bristles widen outwardly in each case, i.e. in particular, a widening occurs toward their free bristle ends. The first bristles preferably have a circular ring sector shaped cross section. This achieves that the first bristles extend further out, in particular tangentially, at the outer envelope in the bristle section of the cosmetic brush than is the case with classic bristles with a cylindrical or cone-shaped geometry. This has an advantageous effect on the initial sectioning behavior, i.e. on the initial parting into sections of the eyelashes or hairs to be treated.

This applies similarly for another preferred embodiment, in which the first bristles have a rectangular cross section in each case.

Both in the embodiment that is provided with the circular ring segment shaped cross section of the first bristles and the embodiment that is provided with the rectangular cross section of the first bristles, the first bristles each have the shape of a disk that tapers off upwardly, i.e. toward the free bristle edges, in particular sharply, and whose flat side normal are [sic] oriented substantially in the axial direction. At the base, i.e. at the point of transition to the main body, these disc-shaped second bristles have an axial base width that is, in particular, in the range between 0.4 mm and 1 mm in a mascara brush and, in particular, in a range between 0.7 mm and 2.2. mm in a hair coloring brush.

Additionally, provision may also be made according to a preferred embodiment that the first bristles are outwardly—i.e. particularly toward their free bristle ends—sharply tapered at least in a plane that is defined by a longitudinal axis of the main body and by a radial direction of the main body. This achieves that the first bristles engage, during a rotational movement of the cosmetic brush, with a sharply tapered cross section profile into the hair or eyelashes being combed. This is advantageous for a good sectioning, combing and separating effect.

According to an additional preferred embodiment, the first bristles have a stepped surface in each case. In this manner, a curling effect can be effected in which the eyelashes or hairs are curled upward by pulling the cosmetic brush out in a rotational movement.

According to an additional preferred embodiment, the first bristles each have a through bore, or at their free outer edge in each case a, in particular, circular sector shaped or V-shaped edge recess. The through bore and the edge recess can then serve as a reservoir in each case for the cosmetic product to be applied, i.e. mascara or hair dye. This cosmetic product also has a certain gliding or lubricating effect and thereby enhances the parting into sections during the first treatment step.

According to an additional preferred embodiment, the first bristles differ from each other at least in parts in their geometric shape or in their geometric dimensions. This makes it possible to attain, depending on the initial positioning of the cosmetic brush as viewed in the circumferential position, to attain different performance characteristics. In particular, also an enhancement of a specific effect, for example a sectioning or separating or combing effect, can be brought about in this manner when the cosmetic brush is rotated. This effect may initially be only slightly pronounced, in order to then become more pronounced with an increasing angle of rotation of the cosmetic brush.

The above-mentioned preferred embodiments may, in particular, also be provided in any desired combination with each other as variants of the inventive cosmetic brush.

Figure 2:
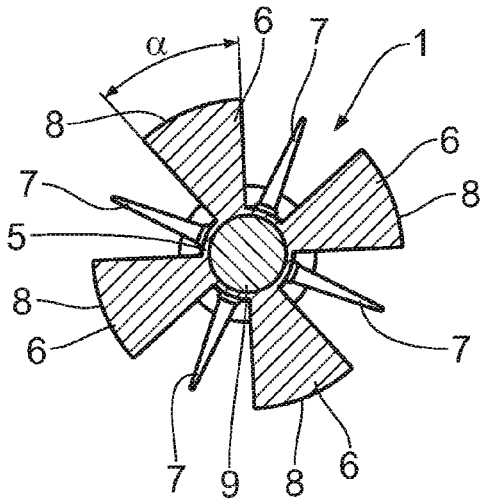
Figure 3:
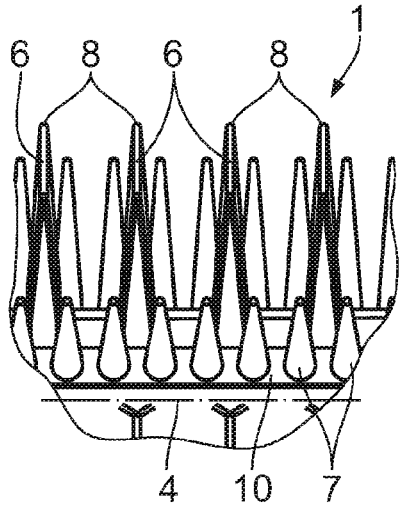

Additional characteristics, advantages and details of the invention will become apparent from the following description of exemplary embodiments in conjunction with the drawing, in which:

FIGS. 1 through 3 show a first exemplary embodiment of a cosmetic brush with two different bristle types in a perspective view (FIG. 1), in a cross sectional illustration (FIG. 2), and in a side detail (FIG. 3), with FIG. 2 showing the cross section II-II according to FIG. 1.

Figure 4:
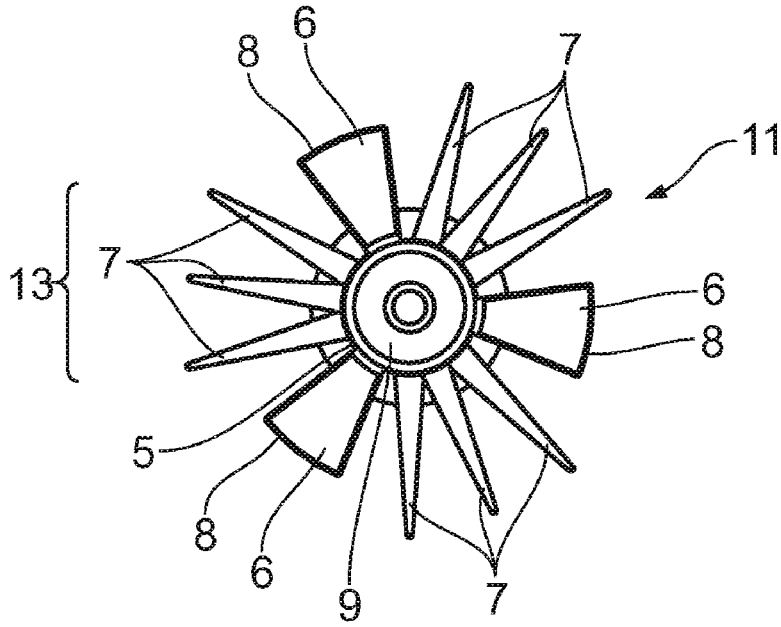
Figure 5:
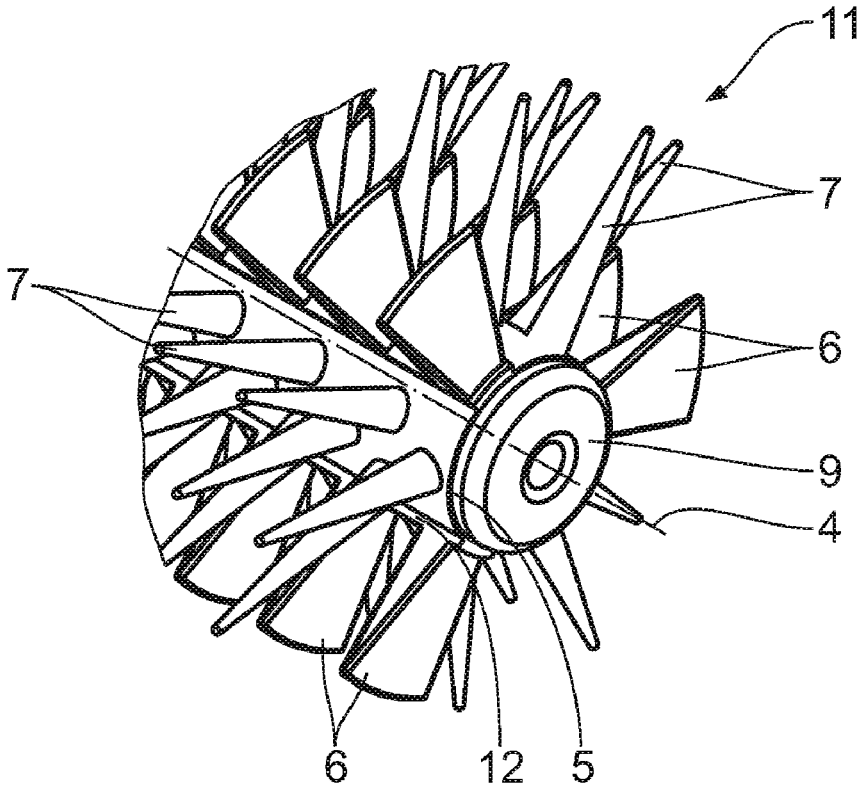
Figure 6:
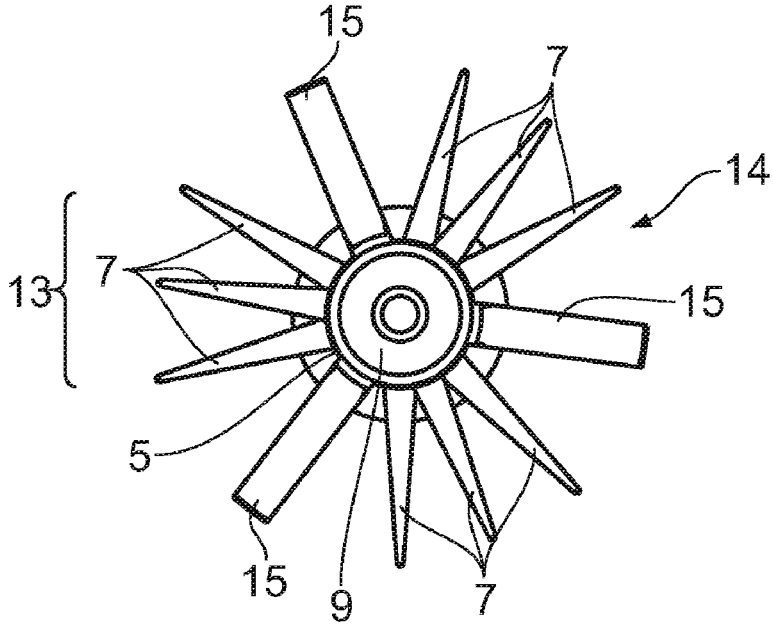
Figure 7:
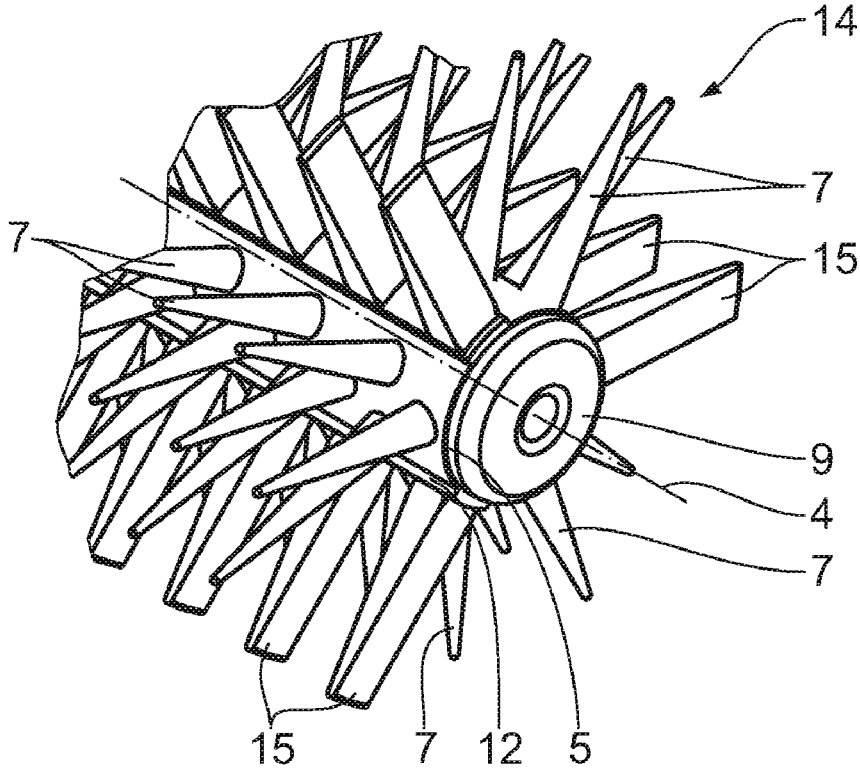
Figure 8:
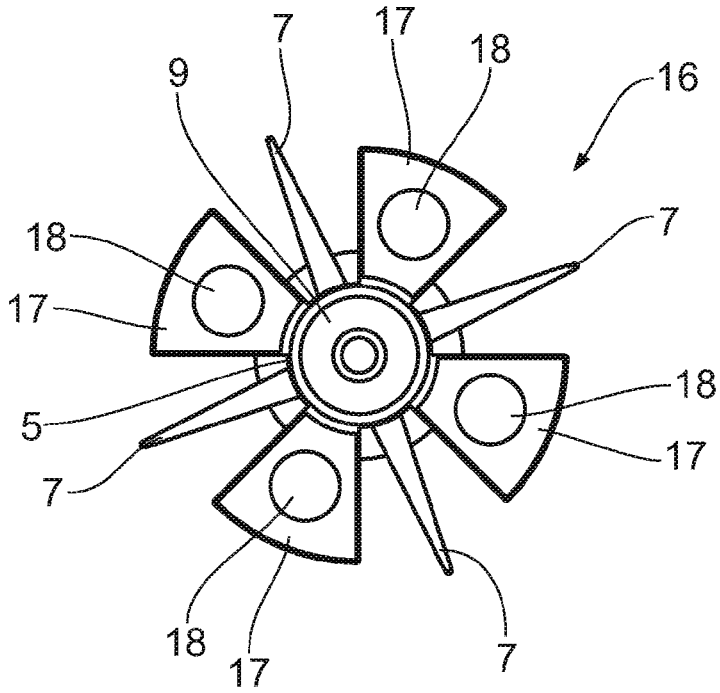
Figure 9:
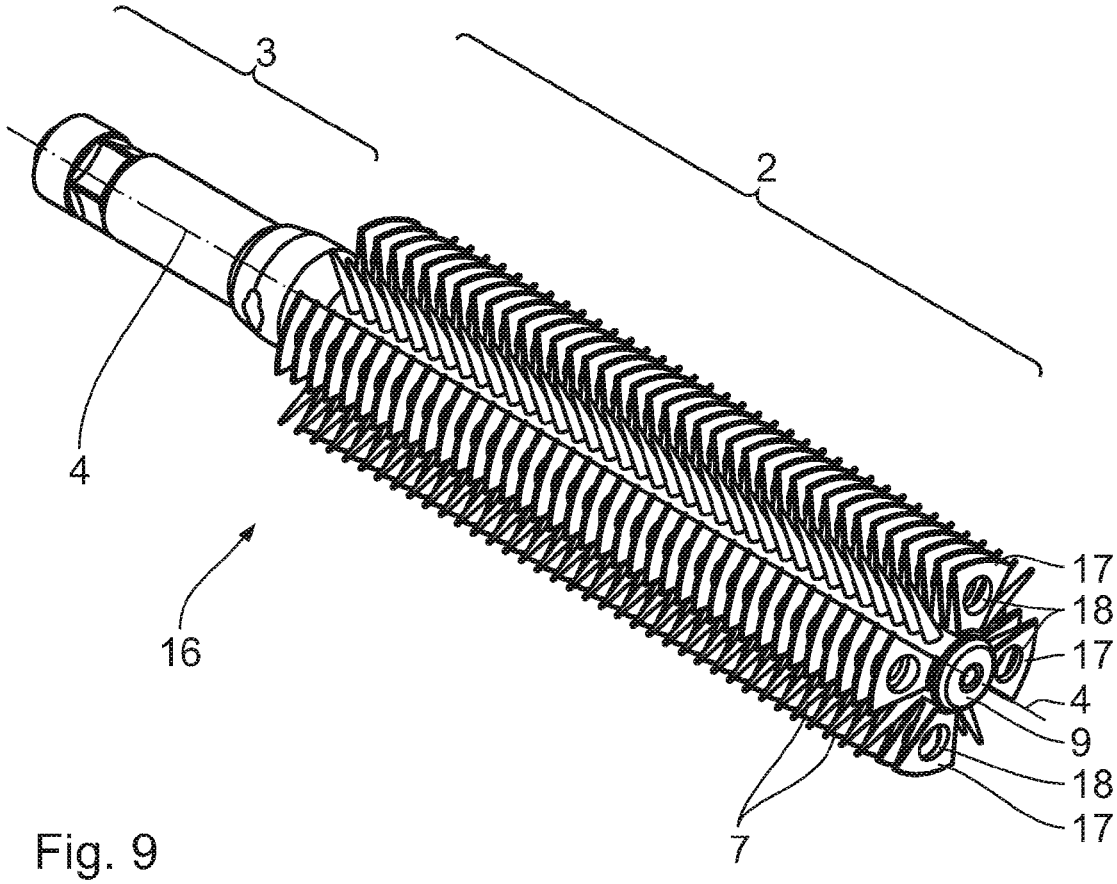
Figure 10:
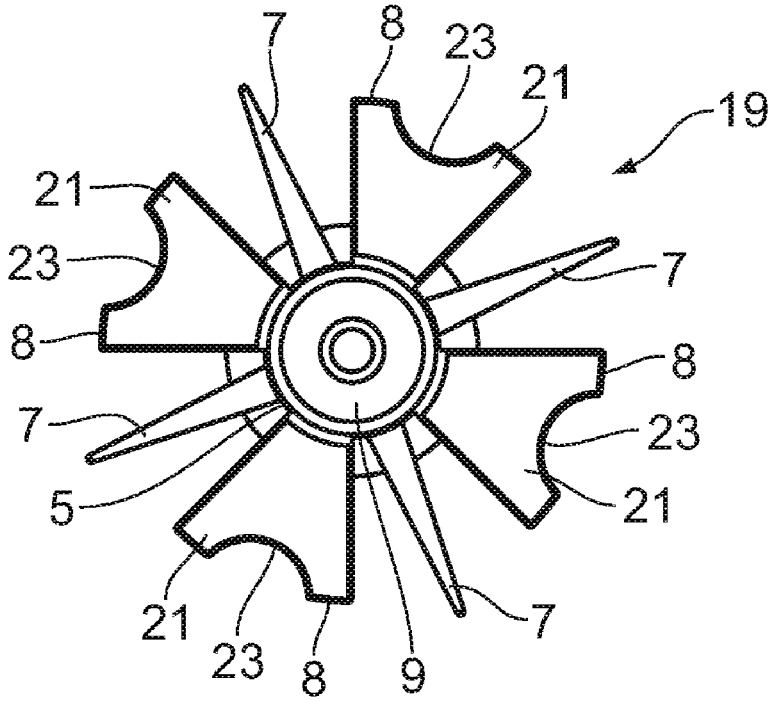
Figure 11:
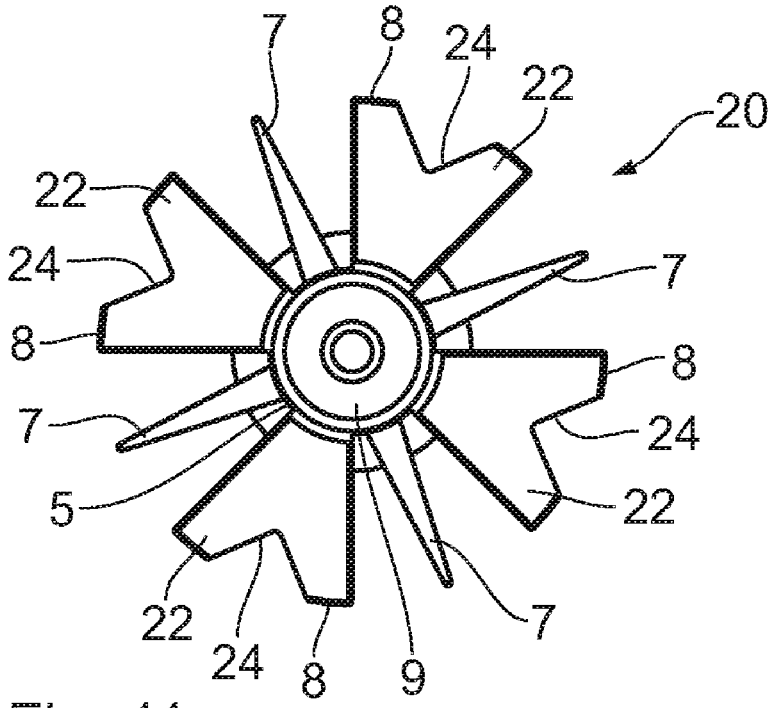
Figure 12:
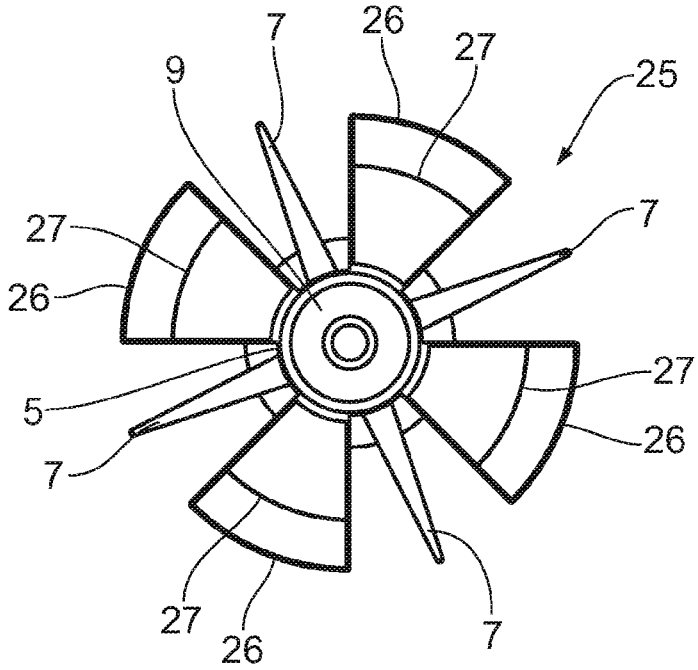
Figure 13:
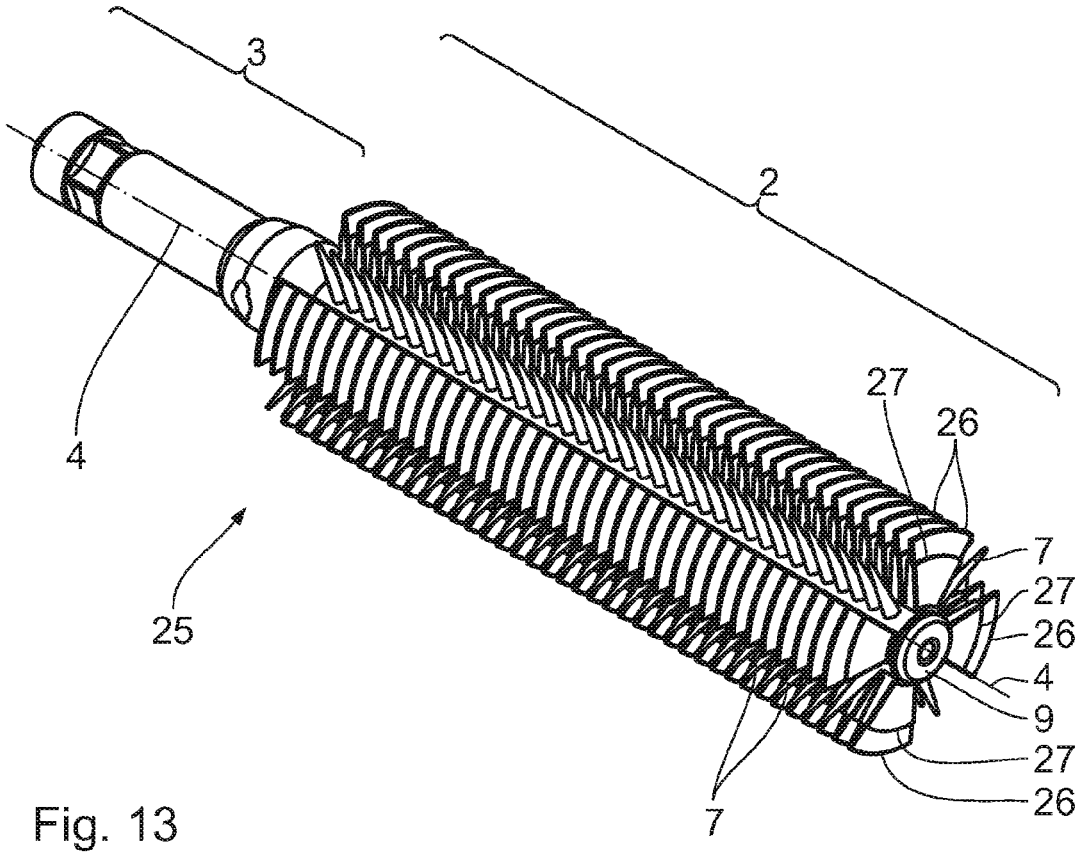
Figure 14:
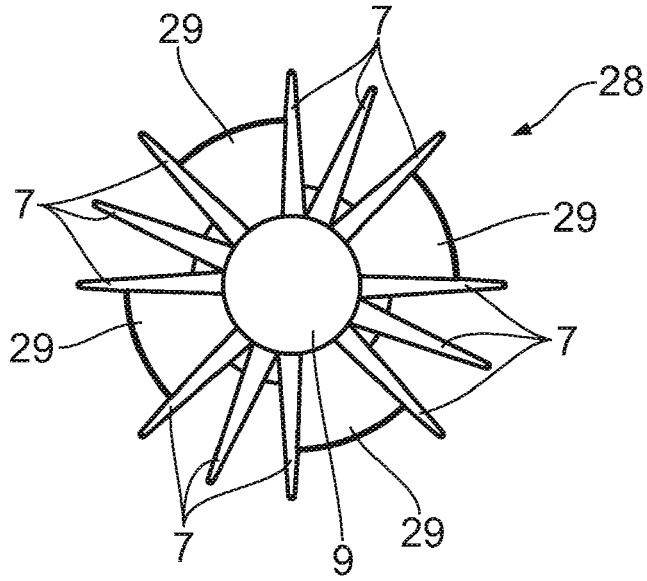
Figure 15:
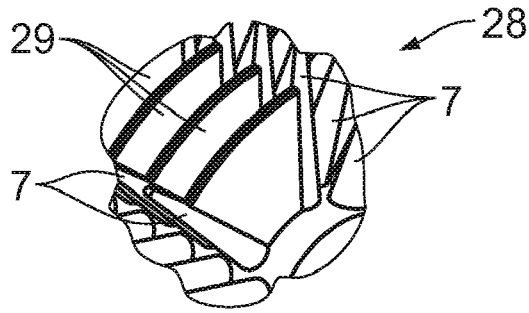
Figure 16:
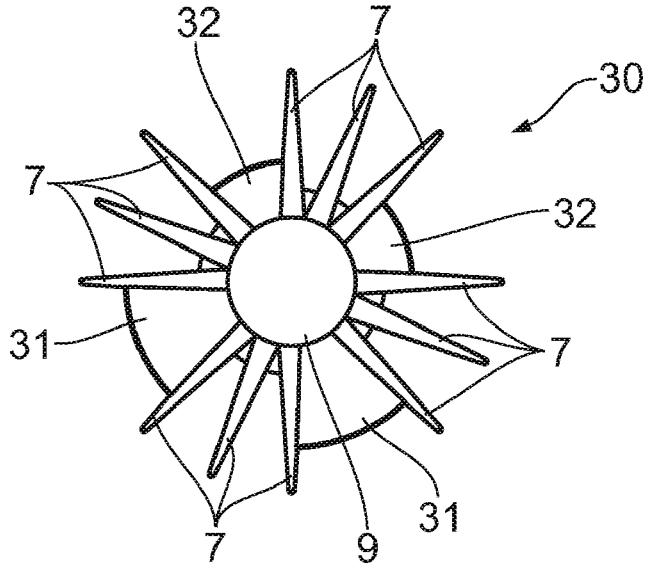

FIGS. 4 and 5 shows a second exemplary embodiment of a cosmetic brush with two different bristle types in a top view from the front and in a perspective view of the front portion, FIGS. 6 and 7 show a third exemplary embodiment of a cosmetic brush with two different bristle types in a top view from the front and in a perspective view of the front portion, FIGS. 8 and 9 show a fourth exemplary embodiment of a cosmetic brush with two different bristle types in a top view from the front and in a perspective view, FIG. 10 shows a fifth exemplary embodiment of a cosmetic brush with two different bristle types in a top view from the front, FIG. 11 shows a sixth exemplary embodiment of a cosmetic brush with two different bristle types in a top view from the front, FIGS. 12 and 13 show a seventh exemplary embodiment of a cosmetic brush with two different bristle types in a top view from the front and in a perspective view, FIGS. 14 and 15 show an eighth exemplary embodiment of a cosmetic brush with two different bristle types in a top view from the front and in a perspective partial view, and FIG. 16 shows a ninth exemplary embodiment of a cosmetic brush with two different bristle types in a top view from the front.

Corresponding parts in FIGS. 1 through 16 are denoted with the same reference symbols. FIGS. 1 through 3 show an exemplary embodiment of a cosmetic brush 1 in the form of a mascara brush. It is designed as an injection-molded plastic piece with a round cross section geometry. The injection-molded cosmetic brush 1 has as its main component a bristle section 2, and axially injection-molded to it a handle extension piece 3, both extending in the direction of a center longitudinal axis 4. Attachable onto the handle extension piece 3 is a handle portion, which is not shown in FIGS. 1 through 3, of the cosmetic brush 1. The bristle section 2 includes a central main body 5 that is essentially designed as a hollow cylinder and, in particular, integrally connected to the handle extension piece 3. Disposed about an outer peripheral surface of this hollow cylindrical main body 5 are a multiplicity of respective first and second bristles 6 and 7. The main body 5 serves as a carrier for these first and second bristles 6 and 7 that radially project outward in each case from the main body 5.

The first bristles 6 are integrally injection-molded in each case to the outer peripheral surface of the main body 5, i.e. integrally connected to the main body 5. They are designed as outwardly sharply tapered discs that have a circular ring sector shape in each case and alternate in the circumferential direction with one of the second bristles 7 in each case. They extend in the circumferential direction over an angle at circumference a, which, in the shown exemplary embodiment according to FIGS. 1 through 3 is 40°. The first bristles 6 consist of the same plastic material as this main body 5. As is apparent especially from the side view according to FIG. 3, the first bristles 6 sharply taper off in a longitudinal section plane that is defined by the longitudinal center axis 4 and a radial direction. In a section perpendicular to the tangential direction, these bristles 6 therefore have a cross sectional area that sharply tapers off toward a free bristle edge 8 of the respective first bristle 6.

The second bristles 7 are connected differently to the main body 5 than the first bristles 6. Here, an, in particular, frictional and form-fitting connection is provided that results from the two-stage injection molding process that is used for the production, which is described in EP 1 507 640 B1. The second bristles 7 extend through through-bores that are formed in the wall of the hollow cylindrical main body 5 and have a tapered cone shape that tapers off sharply or slightly rounded toward the free bristle end in each case. The second bristles 7 are integrally connected to each other due to this manufacturing process by means of a connecting strand 9 that extends in the interior of the main body 5 in the direction of the center longitudinal axis 4. The connecting strand 9 and the second bristles 7 consist of the same plastic material, which is different from that of the main body 5 and first bristles 6.

The injection-molded cosmetic brush 1 is designed within the bristle section 2 as two parts. The first component is formed by the main body 5 with the integrally molded-on first bristles 6. The second component is formed by the connecting strand 9 with the likewise integrally molded-on second bristles 7. The main body 5 and the connecting strand 9 directly adjoin each other, in particular in the region of the inner hollow space of the main body 5. In the boundary region, firmly bonded and/or adhesive connections between the two components may result, at least in parts, in particular due to the above-mentioned manufacturing process.

Due to the different materials and/or the different shaping and/or dimensioning, the first bristles 6 are less elastic than the second bristles 7. The first bristles 6 are hard bristles, the second bristles 7 are soft bristles. Due to the harder material that is, in particular, provided for the first bristles 6 and, therefore, for the main body 5, sufficient mechanical stability and load-carrying capacity of the main body 5 and cosmetic brush 1 as a whole are guaranteed at the same time.

The respective first and second bristles 6 and 7 are arranged successively in altogether four longitudinal rows in each case that extend in the direction of the center longitudinal axis 4. In the tangential direction, adjacent rows of one bristle type, i.e. either of the first bristles 6 or of the second bristles 7, are offset from each other by 90° in each case. In principle, a different number of rows, for example three rows of both bristles types in each case, is also possible, which then are also evenly distributed about the circumference, namely with a circumferential angular offset of 120° in each case (see, at least in parts, FIGS. 4 through 7).

In the exemplary embodiment shown in FIGS. 1 through 3, the second bristles 7 are arranged in a common row on a longitudinal bridge 10 that extends in the direction of the center longitudinal axis 4 on an outer peripheral surface of the main body 5. Similar longitudinal bridges may also be provided for the first bristles 6 (see, for example, the exemplary embodiments according to FIGS. 4 through 13). These longitudinal bridges 10 produce a curling effect, which means that the eyelashes, during the rotating combing movement, come to rest against these longitudinal bridges 10 and are thereby curled upward.

In the additional exemplary embodiments that will be described below, there also are two different bristle types provided in each case that are connected to the respective main body 5 in different manners and that have different degrees of elasticity or hardness. One bristle type has an integral connection, whereas, for the second bristle type, again, a frictional and/or formfitting connection results due to the above-discussed injection molding process.

In the exemplary embodiment shown in FIGS. 4 and 5 of an additional cosmetic brush 11, the first bristles 6 have, similar to the cosmetic brush 1, at a cross section perpendicular to the center longitudinal axis 4, a cross sectional area in the shape of a circular ring sector. However, in this exemplary embodiment, as already mentioned, only three rows of these first bristles 6 are provided, with the rows being offset about the circumference. Additionally, the first bristles 6 are disposed, as was also discussed earlier, on a longitudinal bridge 12 that forms an integral connection with the hollow cylindrical main body 5. In contrast to the cosmetic brush 1, the cosmetic brush 11, however, has disposed between two rows of the first bristles 6 in each case three rows of the bristles 7. They form a circumferential section 13, within which exclusively second bristles 7 are provided.

FIGS. 6 and 7 show an exemplary embodiment of an additional cosmetic brush 14. The significant difference to the cosmetic brushes 1 and 11 of FIGS. 1 to 5 resides in the geometric shape of the first bristles 15. They have in the cross sectional plane perpendicular to the longitudinal axis 4 a rectangular cross sectional area.

Further modifications of the first bristles that are integrally injection-molded to the main body 5 will become apparent from the exemplary embodiments described below in conjunction with FIGS. 8 through 16.

In the exemplary embodiment of a cosmetic brush 16 according to FIGS. 8 and 9, first bristles 17 are provided that, again, have a circular ring sector shaped cross sectional area. These first bristles 17, however, are additionally provided with a through bore 18 in each case.

The additional exemplary embodiments of respective cosmetic brushes 19 and 20 shown in FIGS. 10 and 11 have circular ring sector shaped first bristles 21 and 22, respectively, that are provided at their free bristle ends 8 in each case with respective recesses 23 and 24. The recesses 23 of the first bristles 21 of the cosmetic brush 19 are designed circular ring sector shaped (see FIG. 10), whereas the recesses 24 of the first bristles 22 of the cosmetic brush 20 (see FIG. 11) have a V-shape.

In the exemplary embodiment of an additional cosmetic brush 25 shown in FIGS. 12 and 13, first bristles 26 have a stepped surface. In this exemplary embodiment, each first bristle 26 has on each flat side a step 27 in each case. In principle, however, other embodiments, in which the flat sides have a plurality of such steps 27, are possible as well.

The additional exemplary embodiment of a cosmetic brush 28 shown in FIGS. 14 and 15 differs from the previously described embodiments in such a way that first bristles 29 are provided that extend in the circumferential direction immediately up to the adjacent second bristles 7 in each case. Each of the first bristles 29 is accordingly in direct indirect [sic] contact with the two second bristles 7 that adjoin in the circumferential direction. At the point of contact, the outer geometry of the second bristle 7 in each case is matched to that of the narrow front faces of the adjoining first bristles 29. The second bristles 7 extend further out radially than the first bristles 29.

The same also applies for the additional exemplary embodiment of a cosmetic brush 30 according to FIG. 16, wherein first bristles 31 and 32 are provided that have different geometric extents. In particular the first bristles 31 extend a little further out radially than the first bristles 32.

The above text essentially described variants of the first bristles. For the second bristles 7 deviations from the basic cone shape are possible as well. They may, for example, have a contoured cross sectional area that is provided, in particular, with edges. Preferred, however, are variants in which the cross sectional area continues to decrease the more this cross section approaches the outer radial bristle end. These bristle geometries accordingly sharply taper off toward the free bristle end also.

What is claimed is:

1. A cosmetic brush, comprising a bristle section having a main body and a multiplicity of bristles, that project out from the main body and with which a cosmetic product is applicable, wherein a) a portion of the multiplicity of bristles forms first bristles integrally connected to the main body, wherein the first bristles consist of the same first plastic material as the main body, b) a connecting strand extends longitudinally through a bore in the main body, c) another portion of the multiplicity of bristles forms second bristles that are connected to the main body differently than the first bristles, said second bristles integrally molded on the connecting strand, d) the main body has a main body wall defining the bore, and the main body wall being provided with through holes passing through the wall, the second bristles are integrally connected to each other through the connecting strand and the second bristles extend through the through holes, wherein the main body and the connecting strand are immediately adjacent to each other and adhesively bonded to each other, e) the main body is designed in the form of a hollow cylinder and integrally connected to a handle extension piece, f) the second bristles are softer than the first bristles, and g) the cosmetic brush is designed in the form of an injection-molded plastic piece.

2. A cosmetic brush according to claim 1, wherein the second bristles are connected to the main body by firm bonding, or frictionally or form-fittingly.

3. A cosmetic brush according to claim 1, wherein the second bristles consist of a second plastic material that differs from the first plastic material and is softer than the first plastic material.

4. A cosmetic brush according to claim 1, wherein the second bristles have an outwardly sharply tapered conical shape in each case with a cone angle of 1° to 5°.

5. A cosmetic brush according to claim 1, wherein the main body has a longitudinal axis and also a circumferential direction relative to the longitudinal axis, and the first and second bristles alternate in the circumferential direction at least in sections.

6. A cosmetic brush according to claim 5, wherein circumferential sections are provided, within which exclusively first or second bristles are disposed, wherein one of these circumferential sections extends in the circumferential direction over an angle of circumference span ($\alpha$) between 25° and 90°.

7. (Previously Presented A cosmetic brush according to claim 1, wherein first and second bristles immediately adjoin each other at least in parts.

8. A cosmetic brush according to claim 1, wherein the main body has a longitudinal axis and the first bristles have a lower bristle density in the direction of the longitudinal axis than the second bristles.

9. A cosmetic brush according to claim 1, wherein the first bristles have the same basic geometric shape as the second bristles.

10. A cosmetic brush according to claim 1, wherein the first bristles have a different geometric shape than the second bristles.

11. A cosmetic brush according to claim 1, wherein the first bristles outwardly widen in each case and have a circular ring sector shaped cross section.

12. A cosmetic brush according to claim 1, wherein the first bristles have a rectangular cross section in each case.

13. A cosmetic brush according to claim 1, wherein the first bristles are outwardly sharply tapered in a plane that is defined by a longitudinal axis of the main body and a radial direction of the main body.

14. A cosmetic brush according to claim 1, wherein the first bristles have a stepped surface in each case.

15. A cosmetic brush according to claim 1, wherein the first bristles have a through bore in each case.

16. A cosmetic brush according to claim 1, wherein the first bristles have at their free outer edge in each case, in particular, a circular sector shaped or V-shaped recess.

17. A cosmetic brush according to claim 1, wherein the first bristles differ from each other in their geometric shapes or in their geometric dimensions at least in parts.

18. A cosmetic brush according to claim 1, wherein the second bristles have an outwardly sharply tapered conical shape in each case with a cone angle of approximately 4°.

19. A cosmetic brush according to claim 1, wherein circumferential sections are provided, within which exclusively first or second bristles are disposed, wherein one of these circumferential sections extends in the circumferential direction over an angle of circumference span ($\alpha$) between 30° and 60°.

20. A cosmetic brush according to claim 1, wherein the brush is one of a mascara brush or a hair coloring brush.

* * * * *